United States Patent [19]

Arav

[11] Patent Number: 4,544,449

[45] Date of Patent: Oct. 1, 1985

[54] APPARATUS FOR DE-WATERING FIBROUS SUSPENSIONS

[75] Inventor: Ronnie A. Arav, Lancashire, England

[73] Assignee: Beloit Walmsley Limited, Lancashire, England

[21] Appl. No.: 540,314

[22] Filed: Oct. 11, 1983

[51] Int. Cl.[4] ..... D21F 1/48

[52] U.S. Cl. ..... 162/374; 162/352; 162/364; 162/372

[58] Field of Search ..... 162/374, 352, 272, 364

[56] References Cited

U.S. PATENT DOCUMENTS

| | | | |
|---|---|---|---|
| Re. 29,417 | 9/1977 | Lee et al. | 162/374 |
| 3,194,729 | 7/1965 | Robinson | 162/374 |
| 3,220,920 | 11/1965 | Truxa | 162/374 |
| 3,520,775 | 7/1970 | Truxa | 162/352 |
| 3,574,056 | 4/1971 | Jud et al. | 162/374 |
| 3,741,866 | 6/1973 | Jud et al. | 162/374 |
| 3,778,342 | 12/1973 | Charbonneau | 162/374 |
| 3,940,308 | 2/1976 | Blanchfield | 162/374 |
| 4,140,573 | 2/1979 | Johnson | 162/374 |

FOREIGN PATENT DOCUMENTS 1582342 1/1981 United Kingdom .

*Primary Examiner*—S. Leon Bashore
*Assistant Examiner*—K. M. Hastings
*Attorney, Agent, or Firm*—Dirk J. Veneman; Gerald A. Mathews; Raymond W. Campbell

[57] ABSTRACT

Apparatus for de-watering fibrous suspensions, which apparatus comprises a suction housing and a cover. The cover comprises two or more plank members releasably secured to the suction housing and each having secured thereto a number of foil strips. Each foil strip is secured to the plank member by way of a plurality of spaced apart pins which are carried by and project from the plank member. A channel is defined between the foil strips and the plank member which serves for the removal of water extracted from the suspension. A weir may be disposed in this channel to control the flow of water over the foils and air may be introduced into the channel by way of drillings to assist in control of the water and prevent plugging.

8 Claims, 4 Drawing Figures

APPARATUS FOR DE-WATERING FIBROUS SUSPENSIONS

DESCRIPTION

The present invention relates to apparatus for de-watering fibrous suspension, and more particularly but not exclusively, to de-watering apparatus on a paper machine of the Inverform type in which water is removed predominantly upwardly by suction boxes located above the travelling top forming wire of a continuously moving sandwich formed by the top and bottom wires and a layer or web of fibrous suspension between them. Still more particularly, the invention relates to an improved cover for a suction box.

In paper forming machines water is removed from the fibrous suspension by suction boxes or foil boxes or augmented vacuum foil boxes. These boxes may be disposed either above or below the layer or web of fibrous suspension formed between top and bottom travelling wires. All boxes of the aforementioned types have a cover, and these covers may comprise a plurality of elongate foils which extend transversely relative to the direction of movement of the web of fibrous suspension. In known designs the covers, formed by the foils or suction box covers, are attached to the suction boxes in such a manner that the suction box has to be removed to replace the foils or the cover when a different design style of cover is required. This requires the paper machine to be stopped for lengthy periods in order to rework the main construction.

In the case of inverted suction boxes, i.e. where the water is removed upwardly, there is a greater tendency for the plugging up of the foils to occur, compared to conventional underwire suction boxes.

In British Pat. No. 1582342 the active surface of a suction box de-watering apparatus is defined by a plurality of foils. Each foil is secured directly to the suction box by a respective mounting block. Each individual foil mounting must be machined at a different angle and since this is a large size component the machining of the suction box is complex and expensive.

It is an aim of the present invention to provide improved de-watering apparatus in which the covers for suction boxes and the like can be changed more easily than known designs and with minimum paper machine down time.

It is a further aim of the present invention to provide de-watering apparatus for an inverted suction box which has a reduced tendency to plug.

In accordance with the present invention then, there is provided apparatus for de-watering fibrous suspensions comprising a suction housing and a cover for the suction housing, the cover comprising two or more plank members releasably secured to the suction housing and each having secured thereto a number of foil strips, each foil strip being secured to the plank member by way of a plurality of spaced apart pins which are carried by and which project from, the plank member.

By employing planks, the number of mounting blocks carried by the suction box are reduced and accordingly less machining is required. Furthermore, the number of different angles which have to be machined are reduced to the number of planks employed by virtue of the fact that each plank carries several foils. The plank-pin design is also much easier to manufacture and needs only a small amount of machining. The pins are welded to the planks and the machined surfaces are few and are parallel to each other.

The pins are disposed in parallel spaced apart rows and the foil strips, which are elongate members, are secured either directly but preferably indirectly to one or more rows of pins by the free end of each of the pins in the row or rows so that the foils are spaced from the plank member. An elongate mounting bar having a T-shaped cross-section is preferably interposed between the ends of the pins in one row and the foil. In other words, each foil strip is preferably supported by a, or a respective, mounting bar which is, or are, carried by and secured to the free end of the pins forming the rows. Preferably the adjacent rows of pins are staggered relative to one another in order to minimise any tendency to plug.

In order to obtain a low deflection and high stiffness in the mounting of the foils, a requirement which is especially important for ceramic foils, it is usual to thicken the foil mounting plates. In known arrangements this increases the depth of the channel between adjacent foils and increases the tendency to plug. By securing the foils to planks using pins the foil mounting plate thickness may be reduced without sacrificing the desired low deflection and high stiffness and thereby the tendency to plug is reduced.

The foil strips define an active surface which in use is in contact with the top forming wire in the case of an inverted suction box or the bottom wire in the case of a conventionally orientated suction box. The active surface defined by the rows of foil strips may be straight or curved. The foil strips extend in a direction which is transverse with respect to the direction of movement of the fibrous suspension through the apparatus. Where the active surface is curved, this may be conveniently achieved by arranging for the plank members to be inclined relative to one another. The pins preferably project perpendicularly from the plank member. Slots are formed between adjacent foil strips and the width of the slots may be varied easily using different width of foil strips.

By virtue of the aforementioned construction, a complete plank member can be easily withdrawn and replaced by another when a different cover design is required, i.e. a cover having, for example, foil strips of different shape or spacing, or when changing foil material from plastic or ceramic. The flexibility afforded by this arrangement renders the water removal to be tuned more easily to the requirements of a particular grade of paper. Furthermore, the changeover is less time consuming because the invention renders it unnecessary to remove the suction box to change the cover design.

A channel is defined between the plank members and the foil strips, through which channel the water passes after removal from the fibrous suspension. The small pins only cause minimal obstruction to the flow of water therethrough, and it is easy to keep clean. The shallow depth of the channel ensures high water velocities without being too small to be cleaned properly. The arrangement avoids problems with plugging of the open slots in known designs.

In order to increase water speeds in the area above the foil mounting, compressed air may be introduced at low pressure, above the planks and distributed uniformly to the space between the planks and foil mountings by way of drillings in the planks. The introduction of compressed air in conjunction with a weir which is adjustable controls the flow of a thin layer of water above the foil mounting. This water flows at high speed over the foil mounting and thereby contributes to a reduction in plugging by preventing the fibres from depositing over the box intervals.

The present invention will now be described further by way of example only, with reference to the accompanying drawings, in which.

Figure 1:
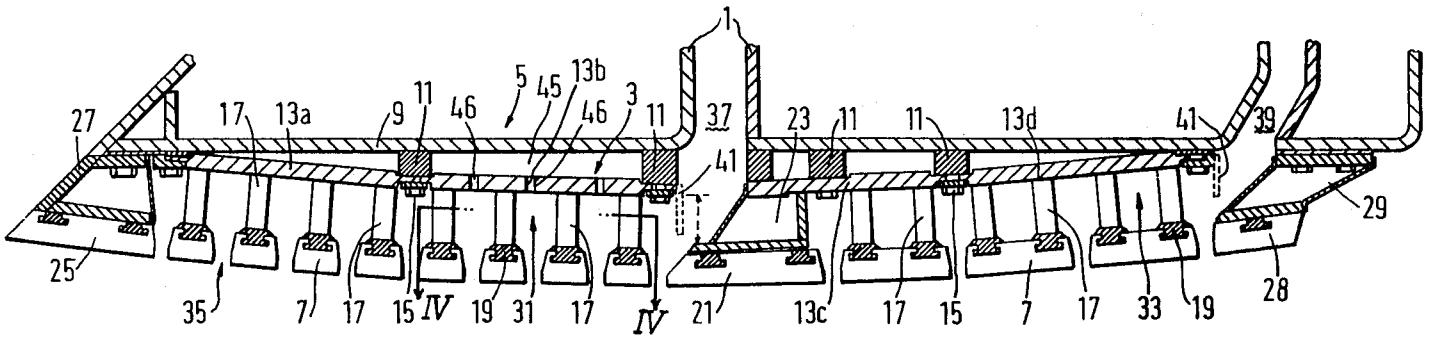
FIG. 1 is a sectional view of one embodiment of apparatus according to the invention.

Referring to FIG. 1, there is shown a section through part of a de-watering apparatus in accordance with the present invention. The drawing illustrates part of a housing 1 of an inverted suction box 5 and the cover 3 therefor. The suction box 5 is, in use, mounted above the travelling top forming wire of a paper forming machine (not indicated in the drawing). The suction box serves to remove water from a layer or web of fibrous suspension disposed between top and bottom forming wires. A plurality of foil strips 7 define an acitve surface which, in use, is in contact with the top forming wire.

The housing 1 of the suction box 5 has a base 9 to which mounting blocks 11 are secured. These mounting blocks serve to support plank members 13 which are releasably secured thereto by bolts 15. In the illustrated embodiment four plank members 13*a*, 13*b*, 13*c* and 13*d* are provided. Each plank member 13 carries a number of the foil strips 7 which are secured to the plank member 13 by way of a plurality of spaced apart pins 17. The foil strips 7 are elongate members which extend in a direction transverse to the direction of movement of the fibrous web through the machine. The pins 17 are disposed in parallel rows and project perpendicularly from the plane of the plank member to which they are connected. The pins in adjacent rows are preferably staggered in order to facilitate water flow. The left hand plank member 13 of FIG. 1 carries four such rows of pins and each row carries a respective foil strip 7. Similarly the plank member second from left in FIG. 1 carries four rows of pins and a foil strip 7 secured to each row. Each foil strip 7 is secured to a row of pins by way of an elongated mounting bar 19 which supports the foils strip. The elongate mounting bar is fastened to the free end of each of the pins in the row. The elongate bar may be extruded T-section stainless steel.

Preferably the pins are welded to the plank member. The construction using planks with a number of foils secured to each reduces the amount of machining. The mounting blocks 11 are machined at the appropriate angle required for each plank. Thus, the number of angles to be machined is reduced by four in the case where the plank carries four foils. The guides for receiving the foils are machined parallel to the plank mounting machine, thus further reducing the machining time. The foils may be machined flat, i.e. parallel to the plank mounting faces or, to obtain higher accuracy of application, half the foil may be machined at a small angle.

Figure 3:
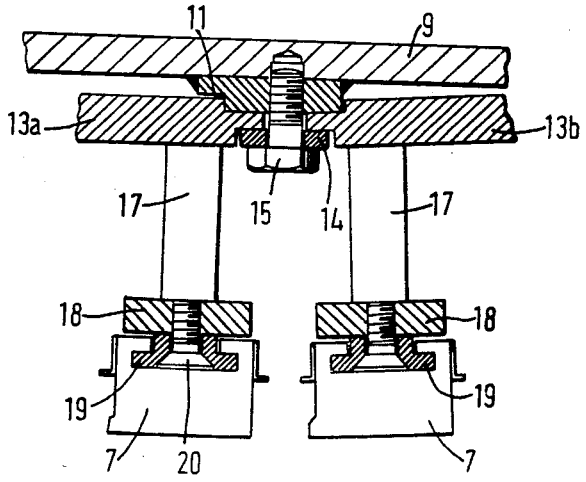
FIG. 3 is a fragmentary detailed sectional view of one possible mounting arrangement.

FIG. 3 shows a detail of a preferred mounting arrangement, from which it will be seen that the mounting block 11 is welded to the base of the suction box 9. The transverse edges of the plank members 13*a*, 13*b* are machined to compliment the machining on the mounting block 11 to arrive at the desired angle for the plank members 13*a*, 13*b* and hence the foils 7 carried thereby. Washers 14 and bolts 15 are employed to secure the plank members to the mounting blocks. As illustrated the pins 17 carry at their free ends an elongate strip member 18 to which the mounting bar 19 is secured by set screws 20.

Figure 4:
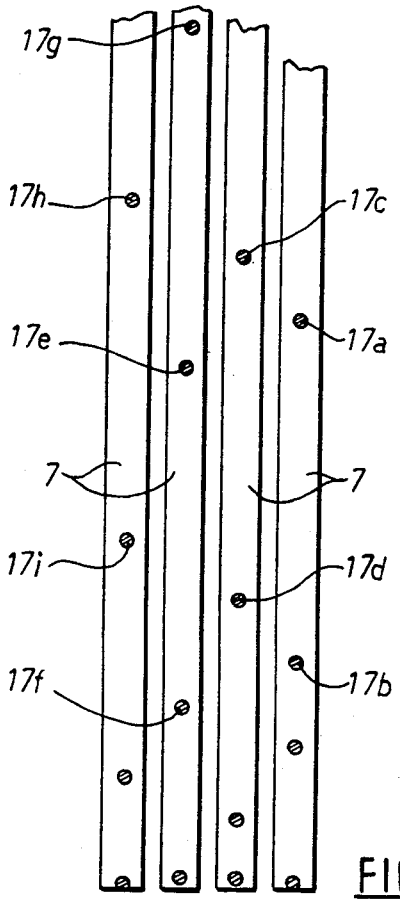
FIG. 4 is a sectional plan view taken along line IV—IV of FIG. 1 showing spacing of the mounting pins securing the foils to a plank member.

Referring to FIG. 4, this illustrates the spacing of the mounting pins 17 which secure the foil strips 7 to the plank members 13. Only part of the foil strip length is illustrated commencing from one end and extending in the cross machine direction transverse to the direction of movement of the fibrous web through the machine, but the view illustrates how the pins 17 are spaced along the length of the foil 7 and are staggered transversely relative to adjacent foils. For the majority of the length of the foil, the pin spacing is regular as shown by the spacing between pins 17*a*, 17*b*; 17*c*, 17*d*; 17*g*, 17*e*, 17*f*; 17*h*, 17*i*; of adjacent foils.

The plank member 13 disposed on the right of FIG. 1 carries four rows of pins 17 but only two foil strips 7. These foil strips are wider than the strips shown on the left of the drawing and each of these wider strips is secured to the plank member by two rows of pins 17. As in the case of the plank members shown on the left, each row of pins carries an elongate mounting bar 19.

The plank member second from the right carries two foil strips. One of these is supported on two rows of pins 17, in the same manner as illustrated for the right hand plank member, whilst the second of these strips 21 is secured to the plank member by way of a bracket 23.

A leading foil strip 25 is carried by a bracket 27, which is releasably secured to the suction box housing and a trailing foil strip is similarly carried by a bracket 29 which is releasably secured to the suction box housing. When designing items 25, 21 and 28, care is taken to avoid any areas that could create any dead flow areas in order to avoid fibre deposits and plugging. A channel 31 is defined between the plank members 13*a*, 13*b* and the foil strips 7, and a channel 33 is defined between the plank members 13*c*, 13*d* and the foil strips 7.

The foil strips 7 are spaced apart to define transversely directed slots 35 therebetween. Water passes through these slots and the channels 31,33 and is removed by way of respective passages 37 and 39.

A weir 41 may be introduced between the channel 31 and the passage 37 and between the channel 33 and passage 39. Where a weir is incorporated, air pressure can be introduced through the cavity 45 formed between the bottom wall of the suction box housing and the plank members 13.

The introduction of air serves to increase the water speed. Compressed air is fed at low pressure into the cavity 45 and distributed to the channel 31 by lines of drillings 46. By way of example these are only illustrated on plank 13*b* but the other planks may also be provided with corresponding drillings. The drillings are arranged so that uniform air distribution is achieved. The weir 41 is preferably made adjustable and is positioned in such a way that only a thin layer of water flows above the foil mounting while air is filling the space above it. This prevents air from escaping. The thin high speed layer of water rushing over the foil mounting contributes to a reduction in plugging by preventing the fibres from depositing over the box intervals.

The width of the slots may be varied by changing the shape of the foil strips. Where the active surface is required to be substantially horizontal the plank members are preferably mounted in a horizontal position.

It is envisaged that the adjacent rows of pins may be of different lengths in order to achieve the desired curvature of the active surface. Preferably the pins would be of the same length in order to standardise planks for interchangeability.

Figure 2:
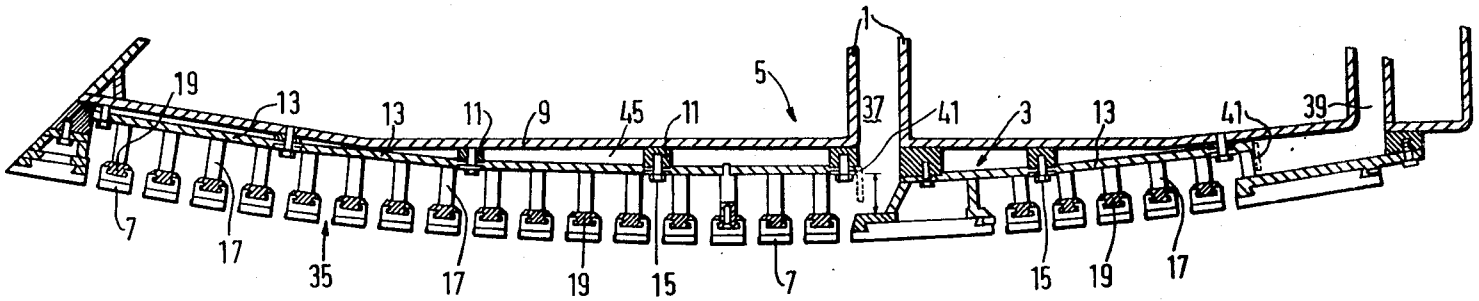
FIG. 2 is a sectional view of a second embodiment of apparatus according to the invention.

The embodiment of FIG. 2 is essentially the same as that described with reference to FIG. 1, and corresponding reference numbers have been used to denote like parts.

In the embodiment, each of the foil strips 7 is supported by a respective row of pins 17. The shape of the foils 7 is different in this embodiment. Four plank members 13 are shown to the left of the passage 37 and two to the left of the passage 39.

The foils 7 may be either plastics or ceramic. Preferably the parts of FIG. 1 are a plastics material such as HDP and the parts of FIG. 2 are a ceramic material.

The embodiments described above have the advantages that there are no bridging pieces along the length of the slots 35 and the material on the sides of each slot can be kept to a minimum. In the case of ceramic covers the need for holding bolts in the slots is avoided. The T-bar mounting and pins can be easily electropolished individually and, when using ceramics, the foil surface can be glazed to promote cleanliness. Plastic foil strips can be machined on planers to a high surface finish on the side of the slots, whereas the present machining process by milling of slots in plastic covers does not lend itself to good surface finish.

The provision of the planks carrying the foils enables plastics foils to be replaced with ceramic foils and vice-versa without changing the suction box design. Naturally, the open area of the active surface can be changed easily by employing foils of different widths. Furthermore, part of the cover mounting can be changed without having to change the complete cover.

The invention reduces the number of spaces required since only four strips and their mounting or only individual strips need to be kept on hand, instead of a complete cover. The invention enables the suction box to be designed and manufactured without compromising any future need for a different cover configuration. The amount of machining of the suction box is minimised. The use of individual foil strips considerably reduces the cost of ceramic and plastic covers.

I claim:

1. Apparatus for de-watering a fibrous suspension through a traveling, forming wire with which it is in contact, comprising:

a suction housing;

a cover for the suction housing;

at least two plank members comprising part of the cover and extending in a direction generally transverse to the direction of travel of the forming wire each plank member being releasably secured to the suction housing and being spaced from said suction housing so as to form a space between each plank member and the suction housing;

each plank having a plurality of spaced-apart pins, each pin having two ends, each pin having one end thereof attached to and projecting from the plank member, said plurality of pins also being disposed in a plurality of spaced-apart rows extending in a direction generally transverse to the direction of travel of the forming wire;

each plank having a plurality of foil strips, each foil strip secured to the plank member at the other end of each of a plurality of spaced-apart pins in a row to define, with the other foil strips, a space between the foil strips and the plank member, and an active surface over the foil strips.

2. Apparatus according to claim 1 wherein the pins are disposed in parallel spaced apart rows and the foil strips are elongate members and are secured to the pins at least indirectly.

3. Apparatus according to claim 1 wherein the pins in adjacent ones of the spaced-apart rows of pins are staggered relative to one another in the direction of forming wire travel in order to minimize any tendency to plug.

4. Apparatus according to claim 1 wherein the plank members are inclined relative to one another to define a curved active surface.

5. Apparatus according to claim 2, wherein:

an elongate mounting bar having a foil engaging cross-section extending in a direction generally transverse to the direction of travel of the forming wire is interposed between the ends of the pins in a corresponding row thereof and a corresponding cross-section cavity in the foil strip, whereby the foil strip is mounted and positioned for selective removal from the mounting bar as desired.

6. Apparatus according to claim 1, wherein:

there are a plurality of plank members in tandem in the direction of forming wire travel.

7. Apparatus according to claim 1, wherein at least one plank member comprises means for introducing compressed air from the space between each plank member and the suction housing into the space between each plank member and the foil strips, said space between each plank member and the foil strips. defining a channel through which water passes after removal from the fibrous suspension.

8. Apparatus according to claim 7 wherein an adjustable weir is disposed in the channel to control the flow of water over the foil mounting.

* * * * *